US005968315A

United States Patent [19]

Meinander

[11] Patent Number: 5,968,315

[45] Date of Patent: Oct. 19, 1999

[54] PROCESS AND APPARATUS FOR SCREENING A FIBRE SUSPENSION IN A PRESSURIZED SCREEN HAVING A ROTATING SCREEN-DRUM

[75] Inventor: Paul Olof Meinander, Grankulla, Finland

[73] Assignee: POM Technology OY AB, Helsingfors, Finland

[21] Appl. No.: 08/836,886

[22] PCT Filed: Nov. 21, 1995

[86] PCT No.: PCT/FI95/00643

§ 371 Date: May 20, 1997

§ 102(e) Date: May 20, 1997

[87] PCT Pub. No.: WO96/16226

PCT Pub. Date: May 30, 1996

[30] Foreign Application Priority Data

Nov. 21, 1994 [FI] Finland ..... 945461

[51] Int. Cl.[6] ..... D21D 5/06

[52] U.S. Cl. ..... 162/55; 209/270; 209/288

[58] Field of Search ..... 162/4, 55; 209/269, 209/270, 288, 406, 730, 370, 273; 210/415

[56] References Cited

U.S. PATENT DOCUMENTS

| | | | |
|---|---|---|---|
| 3,363,759 | 1/1968 | Pounder | 209/273 |
| 3,437,204 | 4/1969 | Pounder | 209/273 |
| 3,814,244 | 6/1974 | Young | 209/273 |
| 4,441,999 | 4/1984 | Frykhult | 210/354 |
| 4,749,474 | 6/1988 | Young | 209/273 |

FOREIGN PATENT DOCUMENTS

| | | |
|---|---|---|
| 0233517 | 8/1987 | European Pat. Off. . |
| 46414 | 3/1973 | Finland . |
| 716013 | 12/1941 | Germany . |
| 3100964 | 2/1982 | Germany . |
| 40566 | 12/1924 | Norway . |
| 331629 | 4/1971 | Sweden . |
| 9323135 | 11/1993 | WIPO . |
| 9323609 | 11/1993 | WIPO . |
| 9323610 | 11/1993 | WIPO . |
| 9323612 | 11/1993 | WIPO . |
| 9517235 | 6/1995 | WIPO . |

*Primary Examiner*—Dean T. Nguyen
*Attorney, Agent, or Firm*—Browdy and Neimark

[57] ABSTRACT

The present invention relates to an apparatus and a process for screening a fibre suspension such as papermaking stock in a pressurized screen especially in connection with pumping the liquid. The invention also relates to the use of the apparatus in a process for the production of paper or board. The apparatus comprises a generally tubular housing (12) and a perforated screen-drum (22) inside the housing. The housing (12) and screen-drum (22) define between themselves a generally annular screening zone (30). The screen-drum (22) surrounds a tubular accept channel (32). The apparatus further comprises a stock inlet (14), outlet (19) for accept, and outlet (17) for reject. The screen-drum (22) is rotatable within the housing (12) and conducts are provided for introducing diluting fluid into the annular screening zone (30) at a plurality of locations along its axial extent. The accept outlet end of the housing (12) preferably widens into a pumping chamber (18) having a pump wheel (26) for pumping the screened suspension.

24 Claims, 6 Drawing Sheets

PROCESS AND APPARATUS FOR SCREENING A FIBRE SUSPENSION IN A PRESSURIZED SCREEN HAVING A ROTATING SCREEN-DRUM

BACKGROUND OF THE INVENTION

1. Technical Field of the Invention

The present invention relates to an apparatus and a process for screening a fibre suspension such as papermaking stock in a pressurized screen especially in connection with pumping said liquid. The invention also relates to the use of the apparatus in a process for the production of paper or board.

The invention relates principally to the removal of impurities from fibre slurries used in the pulp and paper industries. The invention presents an improvement of commonly used pressurized screens, by which the loss of good material together with rejects is minimized so that the cleaning process becomes more efficient, compact and energy efficient and the apparatus is made less complicated. The invention further allows the integration of the pumping, cleaning and stock distribution functions with the screening, whereby the papermaking process is further simplified.

2. Prior Art

In known screens, presented among others in U.S. Pat. No. 3,363,759, a fibre slurry is fed into a space limited at least in one direction by a screen plate through which the fibre suspension is forced, and which prevents fibre bundles and other bigger particles from passing through the screen together with the accepted fraction, i.e. the accept. Due to the mechanism of screening, also a part of the good fibres stop at the screen plate, forming a fibre mat which gradually thickens and prevents the flow through the screen. According to the above mentioned US Patent the fibres collecting at the screen plate are brought back into the suspension by means of turbulence generating bumps in the surface of a rotor.

The temporary hold of fibres at the screen plate also makes the liquid component of the suspension pass the screen faster than the fibres, which causes the suspension being screened to become gradually more concentrated in the screening zone. This gradually decreases the functionality of the screening, until the screening has to be interrupted in order to prevent excessive concentration and a resulting clogging of the screen.

Removing the fraction which is not to pass the screen, i.e. the reject, from the screen, also requires a sufficient volume flow so that the flow speed in reject pipes can be kept sufficiently high, and the separation of solids and consequent clogging of the piping can be avoided.

Due to these phenomena a significant portion, typically 5 to 30%, of the good fibres screened are rejected when screening in a conventional screen. In order to recover these fibres, the reject is re-diluted and cleaned in a second cleaning stage in another screen, the reject of which can be cleaned in a third screen, and so on. The last cleaning stage, normally, comprises an open screen, from which the reject can be removed at a high consistency.

Screening in a multiple of screens is obviously disadvantageous in view of the need for space, investment, energy consumption, cleanliness and also in view of process controllability.

In previously used open screens it was common practice to dilute the goods to be screened in the screening zone. Internal dilution has been attempted, also for pressurized screens and the resulting difficulties have been resolved in various ways. U.S. Pat. No. 3,437,204 avoids stratifications and poor mixing, when diluting through a rotor, by feeding dilution water through a screen plate. EP Patent Application 0233517, aiming at the washing of recycled wastepaper, also introduces water through an opening in the screen plate. Both these solutions lead to consistency differences at the accept side, which would require further equalizing before use in a paper machine. There are also other drawbacks, such as the fast draining of dilution water and consequently an excessive need for such water, complicated screen maintenance, etc.

A problem with most pressurized screens of the prior art is that the rotors have to generate pressure pulses for keeping the screen plate open and permitting the fibres to pass. These pressure pulses are conducted further in a papermaking process, and are a source of disturbance of the forming process, which requires a very stable and pulse-free flow.

SE Patent 331629 describes a pressurized screen with a screen-drum rotating in a cylindrical housing. The screen-drum may be adjusted from a central position to an eccentric one for causing turbulence at the screen. This provides a mechanically complicated solution to the pulsation problem, but leaves the problem related to the thickening of the goods to be screened unresolved.

FI Patent 46414 also describes a screen with a screen-drum rotating in a cylindrical housing. The screen-drum is rotated so as to provide Couette flow in a suspension being screened. Pulsation means are provided for generating pulsations in the flow of particles through the screen. The screen housing may be provided with slits for feeding dilution water into the annular screening chamber for preventing the reject layer collected on the screen from whirling up along the housing.

In conventional screens, the increasing consistency of the goods to be screened cause differences also in the consistency of the accept at different areas of the screening plate. These differences are known to cause consistency stratifications in the accept flow, which stratifications in turn may cause irregularities in a forming paper web.

Most papermachine wet ends involve centrifugal cleaning of the papermaking stock, by means of hydrocyclones. The hydrocyclones typically require an operating pressure differential of 100 . . . 200 kPa and operate in a multiple of hydrocyclones, whereby typically 200 . . . 400 kJ of energy is consumed for every cubic meter of cleaned stock. The hydrocyclones further constitute a considerable investment, and they require continual maintenance.

A generic problem when forming paper or board is the uniform distribution of stock in the cross machine direction and management of profile irregularities. In the same applicant's copending Patent Application WO 93/23609 a multiple of distribution pipes having essentially identical lengths and flow resistances lead directly from the screen to the headbox, thus regulating the stock distribution profile.

The traditional papermachine wet end involves huge volumes of circulating backwater and many feedback loops for secondary cleaning and screening stages. The same applicant's copending Patent Application WO 93/23612 (FI Patent 89728) provides a novel solution to the problems regarding controllability and cleanliness in a papermaking process. Said solution essentially eliminates the huge water volumes and the feedbacks in a paper machine short circulation.

OBJECT OF THE INVENTION

An object of the present invention is to improve the function of known processes and apparatuses in order to provide an essentially complete separation of debris, here called reject, from screened material, here called accept, of the suspension to be screened, here called inject, essentially without losses of good fibres and in one single apparatus.

An object of the present invention is also to provide a screen operating without pressure pulses disturbing the subsequent papermaking process.

An object of the invention is also to provide a screen which does not cause consistency stratifications which may cause irregularities in a forming paper web.

An object of the invention is further to provide a means for cleaning the stock centrifugally in a pressurized screen, thus eliminating the need for separate hydrocyclones in a papermachine wet end.

An object of the invention is further to provide a technically simple pressurized screen, which can be integrated with the pumping of accept for providing a compact and simple process.

A further object of the invention is to provide an integrated means for screening, pumping and distributing a papermaking stock to a former.

An object of the invention is also to provide an integrated means of screening, cleaning, pumping and distributing a papermaking stock.

The process and the apparatus according to the invention are particularly well suited for fast and controlled recycling of backwater drained at the forming of a paper or board web back into the short circulation fibre process.

An object of the invention is therefore also to provide a process for producing paper or board from a papermaking stock, which process includes screening said papermaking stock in a pressurized screen according to the present invention.

SUMMARY OF THE INVENTION

The present invention thus relates to an apparatus for the screening of a fibre suspension comprising a generally tubular housing and a perforated screen-drum inside said housing, said housing and screen-drum defining between themselves a generally annular screening zone and said screen-drum surrounding a generally tubular accept channel, said apparatus further comprising inlet means for inject, outlet means for accept, and outlet means for reject. The screen-drum of the present apparatus is rotatable within the housing and means are provided for introducing diluting fluid into said screening zone at a plurality of locations along its axial extent.

Said diluting fluid may comprise a diluting liquid such as water, a leaner suspension than the suspension to be screened, such as fibre-containing backwater, or it may comprise an additional feed of the inject fluid, such as the actual fibre suspension to be screened. It is to be noted that for the purposes of this specification said diluting fluid or additional fluid is regarded as being a fluid which has not been in contact with the screen and thus has not been thickened by the screening operation. Such a diluting fluid consequently has a consistency which is leaner than the thickened suspension which has been in contact with the screen in the screening zone.

Said plurality of locations may be provided by separate inlet means disposed at a distance from each other in the axial direction of the screening zone. Alternatively, a number of said plurality of locations may be combined or merged to form an axially extended fluid or liquid inlet.

Said plurality of locations may be used for feeding additional inject fluid, such as a fibre suspension; for feeding another dilution liquid, such as fibre-containing backwater; and/or for feeding a washing liquid such as cleaner backwater or pure water.

In a particularly preferred embodiment, the inlet means for inject is merged with a plurality of further inject inlet means to provide an axially extended inject means for feeding a continuous flow of fresh inject fluid over a major axial extent of the screening zone.

The feeding of additional inject fluid over a large portion of said screening zone will counteract the thickening of the stock being screened. The dilutions will, in fact, provide a multistage screening function on one extended screening surface.

According to a preferred embodiment of the invention, said means for conducting diluting fluid include one or several inlet means for feeding washing or dilution liquid into said screening zone. A number of said inlet means may be merged to form an axially extended liquid inlet means.

The washing liquid is preferably introduced towards the end of the screening surface which is opposite to the inlet end and where the coarser reject material will accumulate. The adding of a washing liquid to the thickening reject, will wash acceptable fibres from the reject and allow them to pass through the screen with a part of the added liquid. At the same time the reject will be diluted to produce a sufficient volume flow for retaining the reject piping free from clogging.

The rotation of the screen-drum and the continuous dilution of the fluid to be screened will provide an improved screening effect and it will also provide a certain cleaning effect, since heavier particles will not so easily pass into the slots in the screen surface but will to a large extent be retained on the rotating screen. In order to enhance the cleaning effect, the screen surface is preferably profiled in such a way as to provide ridges between screen slots. An acceleration of the fluid in the void spaces between the ridges, as the fluid passes into the slots, will cause the heavier particles to be flung back, while the lighter fibres will pass through the slots.

A preferred embodiment of the invention comprises an axially extended inlet for thick papermaking stock and a plurality of inlets for diluting backwater extending axially over a major part of the screening zone. The preferred embodiment also comprises a profiled screen-plate for improving the centrifugal cleaning effect.

In a particularly preferred embodiment of the invention the accept outlet end of the screen housing comprises a funnel-like widened portion constituting a chamber with one or more accept outlets at its periphery. A rotatable wheel extends into said chamber to provide an integrated mixing and/or pumping of the accepted fluid. The action of the rotating wheel provides an efficient mixing of the accept and it counteracts any non-uniformity in the accept. Consequently, the accept flow will have a uniform consistency without stratifications.

In a very simple embodiment of the invention the screening apparatus comprises one or two inlets into a screening zone formed between a rotatable screen-drum and a generally tubular housing. One end of said housing comprises a wider pumping chamber with a rotatable pump wheel for providing an integrated screening and pumping action in a compact structure.

The present invention also relates to a process for the treatment of a fluid fibre suspension in a pressurized screening apparatus, wherein said fibre suspension is injected into a first end of a generally annular screening zone formed between a generally tubular screen housing and a screen-drum and a finer portion of said suspension is made to flow through said screen-drum and is extracted as accept, while coarser material is retained on said screen-drum and discarded as reject. Said screen-drum is continuously rotated inside said housing and diluting fluid is fed into said screening zone at a plurality of locations in the axial direction of said screening zone.

In said process a fibre suspension is screened for separating coarse rejects from said suspension by means of a rotating screen-drum, whereby the thickening of the suspension to be screened is counteracted by dilution. Said dilution is provided by a feed of fresh fluid into the screening zone. Said fluid may comprise additional portions of the fibre suspension itself or another liquid such as backwater from a papermachine short circulation.

The continuous addition of liquid to the screening zone provides an essentially total separation of good fibres from the reject before said reject is separated from the screen.

The screening effect may be enhanced by stationary turbulence or pressure generating means. However, since the process lacks rotary pulse generators it does not generate pressure pulses disturbing following process steps.

In a preferred embodiment of the invention the screened suspension, i.e. the accept is pumped to subsequent processing steps by an extension of the screening apparatus acting as a pump.

Generally the object of the present invention is to provide a screening process involving a small overall fluid volume and avoiding feedback loops. Said screening process is especially useful for providing a compact, self cleaning and easily controllable papermaking process.

In a preferred embodiment of the process, a thick stock fibre suspension is introduced into said annular screening zone through a fluid inlet nozzle extending axially over a first portion of said screening zone. Diluting backwater with a relatively high fibre content is introduced through a dilution liquid inlet nozzle extending axially under said fluid inlet nozzle for diluting the thick stock. At about the point of the screening zone, where the fluid inlet nozzle ends, a washing liquid inlet is provided for feeding backwater with a relatively low fibre content into an axial extension of said liquid inlet nozzle to provide dilution and washing of rejected fibres and heavy particles accumulating on the screen-drum.

Normally thick stock introduced into a papermachine short circulation will have a consistency of about 2 to 5%. Said stock will be diluted to a consistency of about 0.5 to 1.5% in the short circulation. However, in the present invention the thick stock need not be separately diluted since the dilution may be performed in the screen itself.

It is to be noted that the present invention will function also with a so called medium consistency stock having a consistency above 5% and up to 20% or more. Since an effective dilution can be provided in the screen, the limitation for the consistency of the inject is set by other considerations, such as the possibility to feed viscous fluids such as medium and high consistency stock.

For a normal papermaking process the dilution in the screening apparatus will be adjusted to provide an accept having a consistency of about 0.5 to 1.5%. However, it is evident to those skilled in the art that the dilution may be chosen at any desired level such as from below 0.1% to above 3%. If medium consistency stock is screened with a minimum of dilution, the accept will also comprise a medium consistency stock.

The water used for dilution purposes is preferably backwater returned from the forming fabric. The backwater draining closest to the headbox generally has a consistency which is about 20 to 60% of that of the stock fed to the headbox, while backwater drained at a downstream end of the forming fabric will normally have about 3 to 30% of said headbox consistency. It is preferable to use the thicker backwater as dilution liquid in the upstream portion of the screening zone and to add the leaner backwater for washing the reject at a downstream point of said screening zone.

The present invention also relates to a process for producing paper or board in a papermaking process including the steps of stock feeding, forming of a web on at least one forming fabric while circulating backwater drained through said forming fabric, pressing and drying said web. Said process comprises feeding paper stock to an inlet end of a generally tubular pressurized screening apparatus including a rotating screen-drum inside a stationary housing, introducing diluting fluid at a plurality of locations along the axial extent of a screening zone formed between said screen-drum and said housing to dilute the suspension being screened, collecting accepted stock inside said screen-drum, and pumping said accept to web forming.

SUMMARY OF THE INVENTION

The present invention, together with additional objects and advantages thereof will be best understood from the following description, when read in connection with the accompanying drawings, of which:

DETAILED DESCRIPTION OF THE PREFERRED EMBODIMENT(S) OF THE INVENTION

Figure 1:
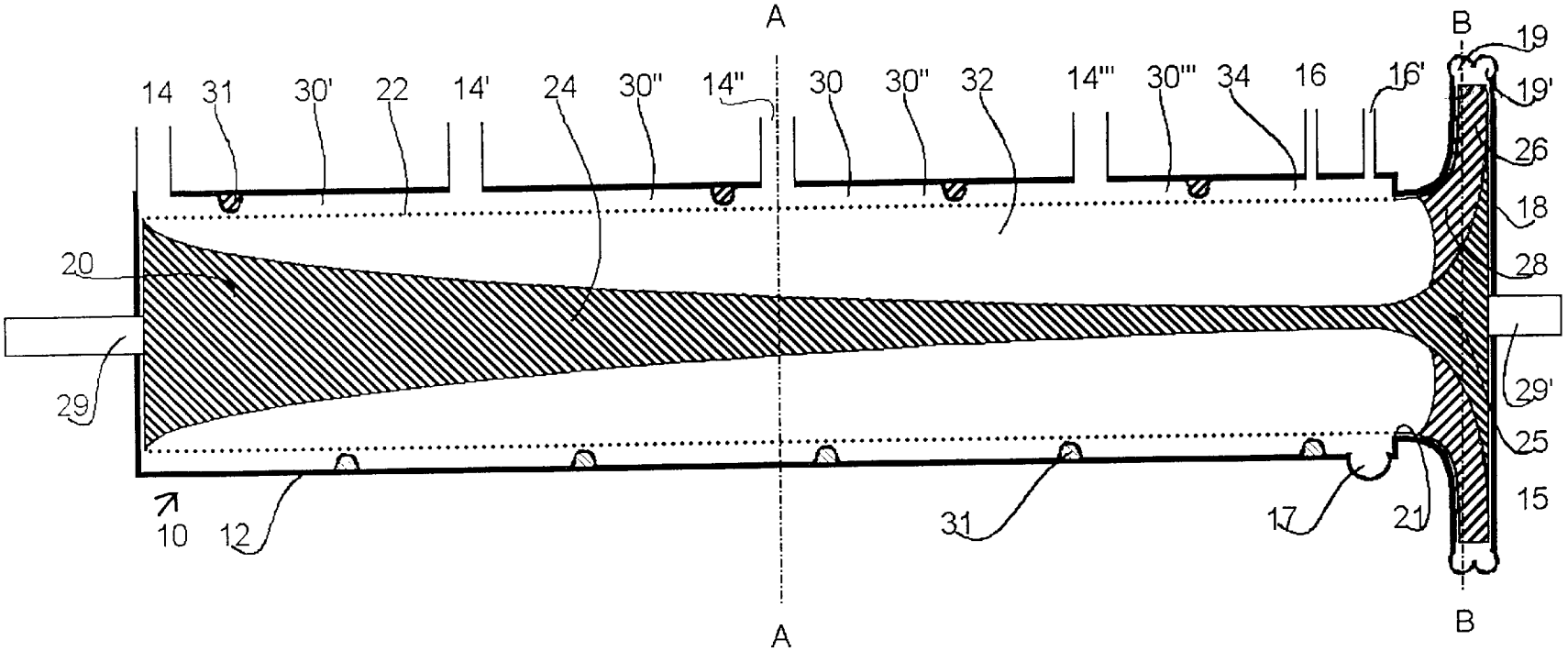
FIG. 1 shows a section of a pressurized screen according to an embodiment of the invention seen from the side.

In the embodiment of the invention according to FIG. 1 the pressurized screen indicated by a general reference 10 comprises a rotor 20 and a stationary housing 12 with inlet means 14 for feeding fluid such as inject stock into the screen.

Said rotor 20 at its central part has an elongated tubular mantle 21 with an essentially cylindrical screen-drum 22. The rotor 20 is surrounded by said housing 12 having an outlet 17 for rejects and multiple additional inlets 14', 14", 14"' for inject stock and inlets 16, 16' for washing fluid. At its outlet end 15 the housing 12 expands to form a pumping chamber 18, having outlets 19, 19' for accept. The rotor is rotatable by means of shafts 29, 29' extending through the ends of housing 12 and sealed by known means for avoiding leakage. At said outlet end 15 said rotor forms a pump wheel 26 with vanes 28 attached to a central body 24 of said rotor 20.

The housing 12 and the screen-drum 22 define between themselves an annular inject chamber and screening zone 30, and the screen-drum surrounds an accept channel 32, extending into the pumping chamber 18 at the outlet end 15. At the reject outlet 17 the screening zone 30 transforms, without a distinct border, into a reject area 34 with washing fluid inlets 16, 16'.

The housing 12 has turbulence generators 31 extending into the screening zone 30 for causing a lateral movement of fibres collecting on the screen-drum 22, corresponding to the turbulence generators commonly placed on rotors of pressurized screens with a stationary screen plate. The turbulence generators 31 in this embodiment are executed as simple bumps, but it is obvious that they may also be executed as foils, or they may have any other shape known to persons skilled in the art, or they may even be constituted by nozzles for feeding inject or dilution water close to the screen-drum.

Figure 3:
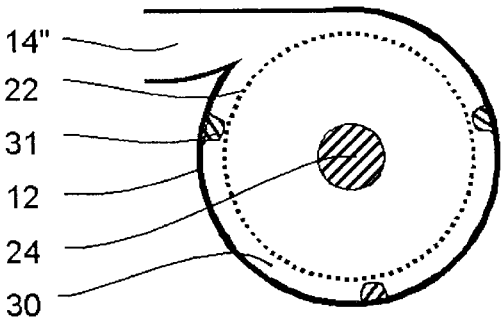
FIG. 3 shows a section of the pressurized screen of FIG. 1 along line A—A.
Figure 3A:
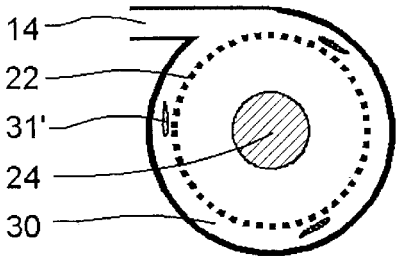
FIG. 3*a,* 3*b,* 3*c* and 3*d* show alternative sections of a pressurized screen, functioning essentially as the one in FIG. 1, along lines corresponding to line A—A in FIG. 1.
Figure 3B:
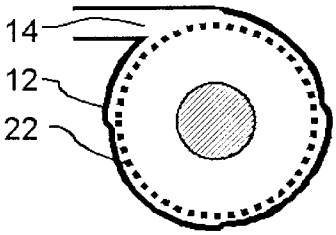
Figure 3C:
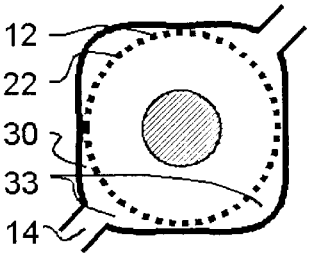

Turbulence may also be provided by making the inner wall of housing 12 have a polygonal configuration, as shown in FIG. 3*c,* or an irregular configuration, which will cause turbulence at the screen-drum 22 as in FIG. 3*b*. Any such turbulence means will have a stationary character.

In the embodiment of FIG. 1 the central body 24 is of a mainly conical shape, so that the cross-section of accept channel 32 gradually increases toward its outlet end, being, in a way, proportional to the screen-drum area passed. Thus, a close to constant rate of axial flow can be maintained in said accept channel.

At the outlet end 15 of the screen the screen-drum 22 ends and the rotor mantle 21 widens and smoothly transforms into a pump wheel 26 with a larger diameter and the central body 24 similarly widens to form a back wall 25 of the pump wheel 26.

The pumping chamber 18 preferably has multiple outlets 19, permitting a direct distribution of the accept over the width of a former placed downstream of the screen. This eliminates the need for separate means for cross-machine distribution of stock. Pumping chamber 18 may also be made with a single outlet like in conventional pumps.

The reject is extracted through reject outlet 17, preferably tangentially in the direction of rotation of rotor 20, whereby the kinetic energy of rotation may be used for pumping the reject through a reject thickener (not shown) or to other further treatment.

Figure 2:
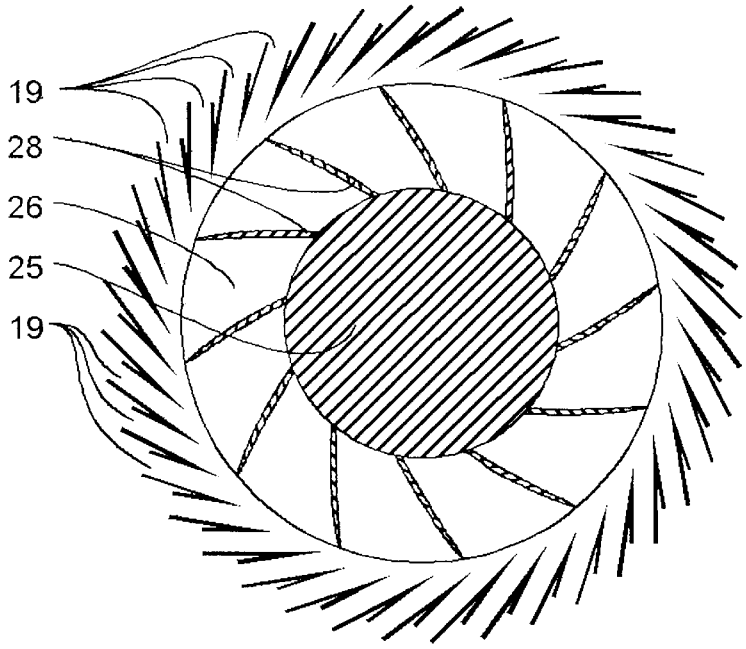
FIG. 2 shows a section of the pressurized screen of FIG. 1 along line B—B.

FIG. 2 shows a section B—B of the screen of FIG. 1 at its pumping section and the arrangement of the multiple outlet pipes 19 tangentially to the periphery of the pumping chamber 18. The arrangement of vanes 28 is provided for minimizing pulsations and other disturbances, in a way known to persons skilled in the art. In order to provide a sufficient number of accept outlets 19, said outlets may be arranged in several layers. Outlets 19, 19' in FIG. 1 are, for instance arranged in two such layers.

Figure 3D:
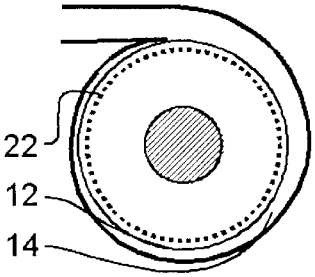

FIG. 3 shows a section A—A of the screen of FIG. 1 at the screening zone. The inject inlet pipe 14" is directed tangentially to the rotation of screen-drum 22 in order to preserve the flow speed energy of the inject. According to the needs of the particular cases, the flow direction may also be directed contrary to the rotation, e.g. for generating turbulence at the screening surface or in intermediary directions. The inlet pipe(s) 14 may also be arranged to feed inject helically around the circumference of the housing 12, as shown in FIG. 3*d*.

FIG. 3*a* shows the cross section of an embodiment where turbulence generators 31' are shaped as foils. Such foils can alternatively be arranged inside the screen-drum 22, whereby the central body 24 would preferably be arranged as a static element supporting the foils.

FIG. 3*b* shows one of many alternative irregular shapes of the housing 12 for causing the screening goods to flow along the screen-drum 22 with variable speed, causing turbulence and suction pulses, which lift fibres deposited on the screen-drum.

FIG. 3*c* shows an embodiment where the housing 12 has an almost square shape for dividing the screening zone 30 into screening channels 33 and for causing speed-variations in the screening goods whereby a suction pulse is caused at the entrance of each of the screening channels. It is obvious for persons skilled in the art that the housing can be shaped as any polygon or have many alternative shapes causing a similar effect.

FIG. 3*d* represents a helical inject channel 14 arranged around the circumference of a cylindrical housing 12.

During operation, a portion of the inject fluid, such as a fibre slurry is fed through inlet 14 to a first screening section 30' of the screening zone 30. The feeding pressure causes a flow through the rotating screen-drum 22 to accept channel 32. An acceptable fine fibre fraction flows with the flow to the accept channel 32 whereas the screen-drum retains the coarse reject fraction and also a statistical part of the acceptable fibres.

The fibres depositing on the screen-drum 22 are removed and brought back into the suspension by the turbulence prevailing in the screening zone due to the relative velocity difference between screen-drum 22 and housing 12. The turbulence in the embodiment of FIG. 1 is further enhanced by means of the turbulence generators 31 extending from the inner walls of the housing 12 to the vicinity of screen-drum 22.

Because the screen-drum retains the material to be separated as well as part of the acceptable fibres, relatively more water than solids pass the screen-drum 22. Therefore the solids content tends to increase in the screening zone 30' as the injects flow toward the outlet end 15 of the screen.

Figure 4:
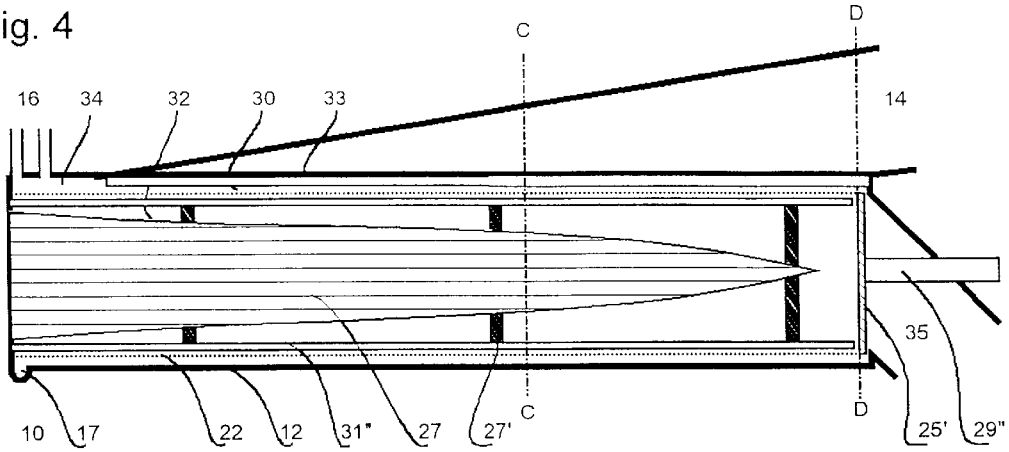
FIG. 4 shows another embodiment of the screen according to the invention.

A second portion of inject is fed through the next inject pipe 14' downstream along the screening zone, where it mixes with the retained portion of the inject retained in screening section 30'. The resulting inject mixture consequently will have a solids content lower than the one at the end of screening section 30', but higher than the solids content of the inject. The mixture is screened in the following screening section 30", whereby the solids content again increases downstream, until a new portion of inject is fed through inject pipe 14". The solids content in the screening zone 30"' is kept at a level suitable for screening by subsequent injection of inject through inject pipe 14"'. The number of inject pipes and dilution steps may be arranged according to practical needs. The inject feeding may even be continuous over the length of the screening zone, as shown in FIG. 4.

When all inject is fed, and the solids content further increases, the screening zone gradually transforms into a reject zone 34, where dilution water is fed into the screen through washing fluid inlets 16, permitting a further flow through screen-drum 22, whereby the remaining acceptable fibres pass with the flow into the accept channel 32, the screen-drum retaining substantially only coarse reject material. The reject is extracted from the reject zone through reject outlet 17.

The accept flows in accept channel 32 toward the outlet end 15 and into pump wheel 26, which accelerates the accept and presses it into accept outlets 19, and further to subsequent process steps. The pump wheel can be arranged with multiple flow channels and tapered and inclined vanes according to solutions commonly known from fan pumps for paper machines. The pump functions as an efficient mixer and eliminates any stratifications in the screened fluid.

By connecting the outlets directly to the papermachine headbox through pipes of identical diameter and length a very compact and exact feeding is obtained. Possible pulses from the pump-wheel may be attenuated through phasing the pipes so that adjacent pipes at the headbox correspond to different pulse-phases in the pump wheel.

This arrangement allows maintaining a high flow speed in the pipes, avoiding dirt build-up, and also maintaining the kinetic energy of the suspension, avoiding energy losses through retardation and subsequent acceleration of the flow.

FIG. 4 represents another embodiment of the invention, where the parts and reference numbers correspond mainly to those presented in FIG. 1. The screen in FIG. 4 functions essentially in the same way, as the screen according to FIG. 1. However the inject feeding 14 is arranged over a nozzle 33 extending over the major part of the screening zone 30. The accept is extracted directly from the accept channel 32 through accept outlet 35. The reject zone 34 and reject outlet 17 are in the end opposite to the accept outlet 35.

The embodiment is shown with only one axially extended nozzle, but it is evident that the housing may be provided with two or more axially extended inlets around the periphery of the housing.

Further, in the embodiment of FIG. 4 a stationary central body 27 and stationary foils 31" are arranged inside the accept channel 32.

Figure 4A:
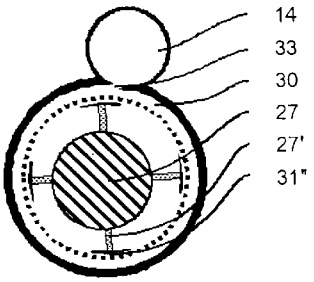
FIG. 4*a* shows a section of the screen of FIG. 4 along line C—C.

FIG. 4*a* shows a section C—C of the screen of FIG. 4, with its inject inlet 14 connected to screening zone 30 by means of inject nozzle 33 and foils 31" connected to the central body 27 by supports 27'.

Figure 4B:
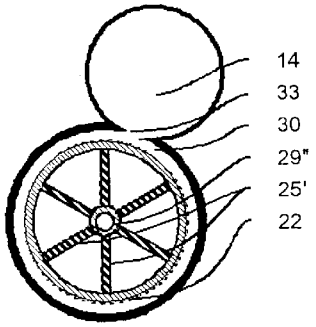
FIG. 4*b* shows a section of the screen of FIG. 4 along line D—D.

FIG. 4*b* shows a section D—D of the screen of FIG. 4, with the outlet end of the screen-drum 22 supported and driven by radial supports 25', connected to the a 29", while leaving space for the accept to flow to accept outlet 35. At the opposite end the screen drum is either rotating freely or supported in one of a number of ways known to persons skilled in the art.

The accept outlet 35 is preferably formed as a spiral for recovering the kinetic rotational energy of the accept stock.

Figure 5:
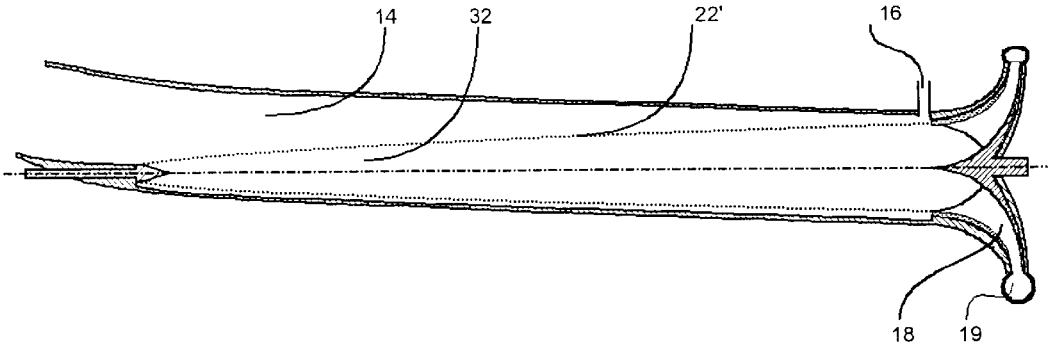
FIG. 5 shows a further embodiment of the screen according to the invention.

FIG. 5 shows an embodiment of the invention in which the screen-drum 22' has a conical or paraboloidal shape permitting the accepts to flow with an essentially constant and high axial speed in the inject channel 14 and accept channel 32. At the end of inject channel 14 there is an inlet 16 for washing fluid. The pumping chamber 18 has a single accept outlet 19.

Figure 6:
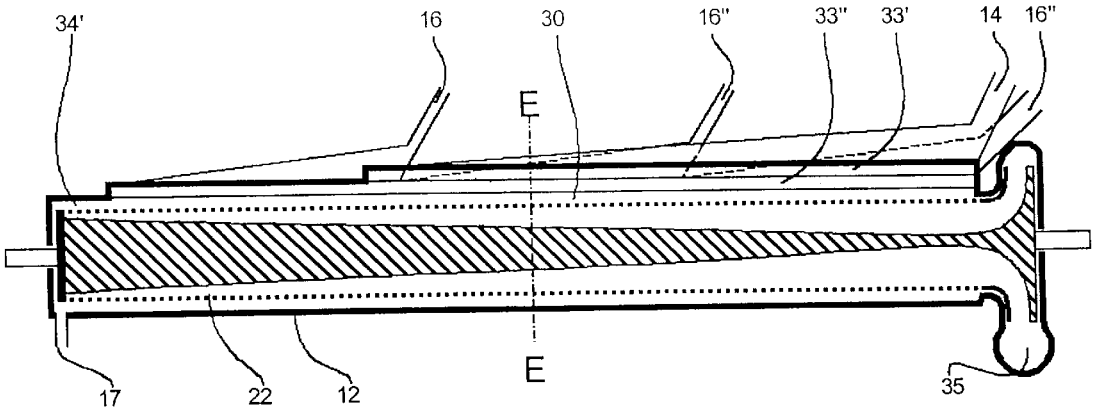
FIG. 6 shows a section of a preferred embodiment of the pressurized screen according to the invention.

FIG. 6 represents a preferred embodiment of the invention, with an inlet 14 for thick stock to be screened connected to a fluid inlet nozzle 33' extending over a major part of the screening zone 30. The embodiment includes also inlets 16" for dilution fluid and an inlet 16 for washing fluid connected to a liquid inlet nozzle 33" extending over the axial length of the screening zone 30, between the screen-drum 22 and the housing 12. An extension of the screening zone 30, defined in its axial length by the liquid inlet nozzle 33" forms a reject zone 34', with a reject outlet 17. The reject zone 34' and reject outlet 17 are in the end opposite to the inlet 14 for thick stock, while the accept outlet 35 is in the same end as said inlet 14.

Figure 7:
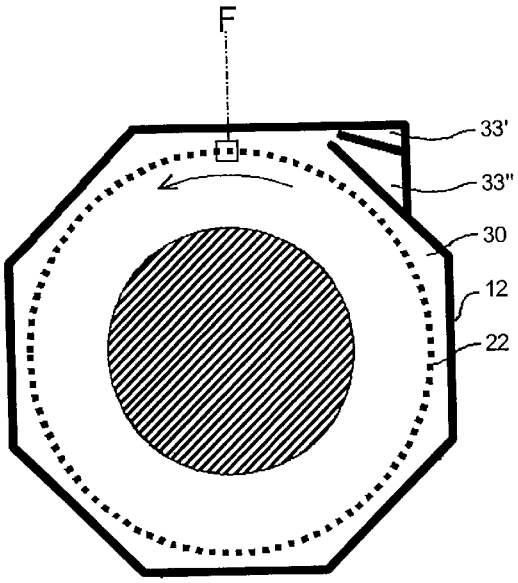
FIG. 7 shows a section of the pressurized screen of FIG. 6 along line E—E.

FIG. 7 shows a section E—E of the screen of FIG. 6, with the inlet nozzle for thick stock 33' superimposed over the inlet nozzle for liquid 33". The screening zone 30 is formed between the housing 12 and screening drum 22 and has a variable depth for causing the screening goods to flow with variable peripheral velocity, as the drum rotates in the direction of the arrow. Thus, pressure and suction pulses are generated at the screening drum.

The pressure pulses are particularly advantageous when screening so called medium consistency stock, as said pulsations will be effective to fluidize the fluid and will enable the fluid to be screened with a minimum of dilution.

Figure 8:
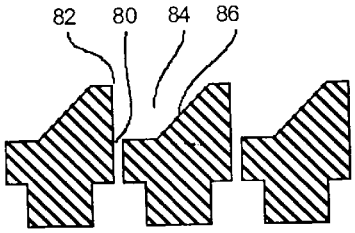
FIG. 8 shows a section of a profiled screen-plate which may be used in the pressurized screen.

FIG. 8 shows a magnification of the screening drum 22, section F in FIG. 7, having longitudinal screening slots 80 extending axially, either in parallel or at angles, along the screening drum 22, having elevated edges 82 above the screening slots 80, and a void space 84 between the screening slot 80 and edges 82 on each side of the slot. FIG. 8 shows one of many alternative screen profiles, known to persons skilled in the art.

During operation the screen plates, as represented in FIG. 8 move from the right to the left and cleaning stock is pressed into the void 84 and further into the screening slot 80. Due to the velocity difference between the rotating screening drum 22 and the screening stock, the stock is accelerated violently when entering the void 84 and passing to the slot 80, whereby heavy particles are separated from the flow by the centrifugal force, hit the wall 86 and are returned into the screening goods. Thus a centrifugal cleaning effect is obtained at screening.

In a process according to the invention the inject suspension to be cleaned is kept at a consistency suitable for being screened by means of continuous dilution. The dilution may initially be done by a gradual feeding of inject stock into the screening zone 30 and subsequently by the injection into the reject zone of a washing liquid, preferably papermachine backwater. However, the present invention will also function if an injection of backwater is made also to the screening zone 30.

The invention also functions when thick stock and backwater are fed in parallel, the dilution of thick stock to a consistency suitable for screening taking place in the screen itself. By this solution a particularly compact papermaking process may be provided.

A special advantage of the present invention is that it provides a means for centrifugal cleaning of papermaking stock integrated into the screening process, thus eliminating the need for separate centrifugal cleaners.

A particular advantage of the present invention resides in that the turbulence generating means are stationary and, thus, do not generate pressure pulses which might disturb the subsequent sheet forming process.

Figure 9:
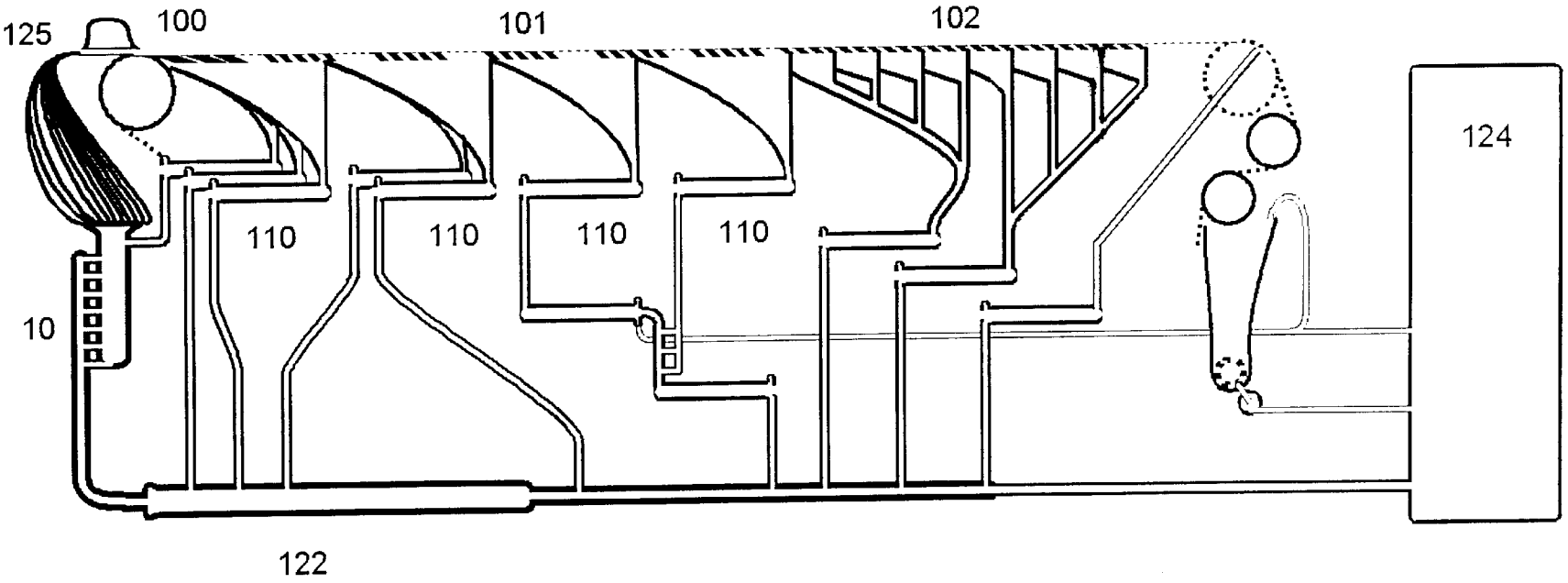
FIG. 9 shows a papermachine wet end, in which a pressurized screen according to the invention is used.

FIG. 9 represents a papermaking process where the advantages of a screen functioning efficiently in one single step without causing pressure pulses is utilized particularly efficiently.

The main process in question is explained in detail in the same applicant's copending Patent Application WO 93/23612 (FI Patent 89728). In said papermaking process the paper stock is fed as a controlled flow as a suspension of about 3 to 5% consistency from stock preparation 124 to the short circulation of said papermaking process. The stock is first diluted to a consistency of about 0.5 to 1.5%, whereafter it is brought to a centrifugal separator 122. A preferred separator is the cleaner described in the same applicant's copending Patent Application WO 93/23610 (FI Patent 90358). Said cleaner functions in a single stage, without recycling of reject. In the separator backwater recycled essentially free of air from the sheet forming part is used for dilution and washing of reject.

The cleaned stock is then brought forward to a screen 10 according to the present invention, where it is screened in one stage, without a need for further screening of rejects. Recycled air-free backwater is preferably used as dilution fluid, thus permitting a recycling of such back-water very close to the head-box 100. Hereby a particular advantage of the screen according to the invention is provided by the absence of rotary turbulence or pulsation generators, which allows the stock to be distributed evenly and without pressure pulses to said headbox.

From the pressurized screen 10 the stock is brought to the paper machine headbox 100, which is preferably done through a particular distribution piping 125. The distribution piping 125 consists of multiple accept pipes of the screen 10, arranged so that they are of essentially equal length, and further so that the number and curvature of eventual sharp bends are essentially identical for all pipes. With this arrangement, and by integrating the pumping function into the screen according to the present invention, a uniform distribution of stock across the whole width of the paper machine involving a minimum process volume and consequently without delay in feeding the stock can be granted.

From the headbox 100 the stock is fed to a sheet forming part, which can be of different known types. During sheet forming the major part of the water contained in the fibre suspension is drained into separate draining boxes 101, 102 in connection with the forming fabric or fabrics. The backwater, collected in the draining boxes, is preferably recycled back into the main process flow as separate air-free flows, without passing through open vessels, by means of multiple pumps of which at least a part are preferably air separating pumps 110, such as gas separation pumps according to the same applicant's copending Patent Applications WO 93/23135 or FI 935853.

From the sheet forming part shown in FIG. 9 the formed paper web is made to finished paper through the subsequent process stages of pressing, drying and reeling. Depending on the grade of paper to be produced the process stages vary and may or may not involve a number of other process stages, like sizing, coating, calendering, sheeting, wrapping and many others, known to persons skilled in the art.

Figure 10:
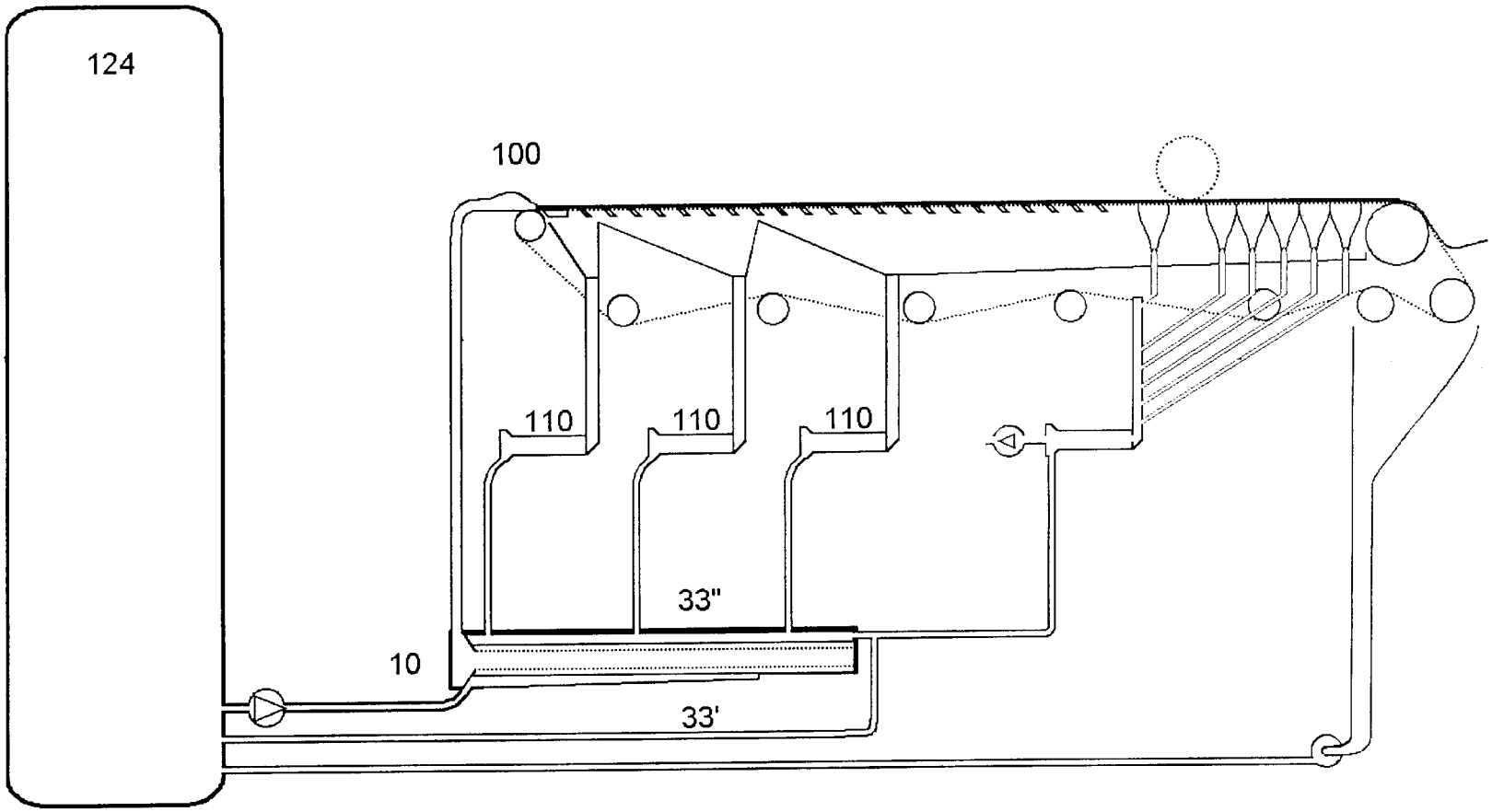
FIG. 10 shows a papermachine wet end in which a screen according to FIG. 6 is used.

FIG. 10 represents a particularly favorable papermaking process where the centrifugal cleaning effect of a preferred screen 10 according to the invention, as shown in FIG. 6, has replaced the need for separate centrifugal cleaners, and mixing of thick stock and backwater is made in the screen itself. Papermaking stock from stock-preparation 124 is fed into the centrifugal screen 10 through stock inlet nozzle 33' and backwater is fed directly from de-aerating pumps 110 to the backwater feeding nozzle 33", diluting the stock in the screen.

According to the presented favorable process the backwater to be recycled is brought to the various dilution points of the short circulation as separate flows, so that the dilution water required by the screen, subject to the present invention, and by the cleaner preceding the same in the stock flow, flows directly to the stock main flow, without tube ramifications or upstream recirculations.

In said process it is further preferred to return the backwater first drained through the forming fabric and containing the highest proportion of drained fibre material as close to the headbox as possible.

The single stage function, without feed back of reject and without recycling of backwater or fibre suspension essentially accelerates reaching of a new state of equilibrium in connection with a change of paper grade or process adjustment, and thus considerably reduces the amount of waste paper produced at a grade change and improves the process controllability.

The present invention has been described principally as a screen solution relating to the paper machine wet end. It is, however, obvious for persons skilled in the art that the screen can be used for many other purposes when separating a coarse fraction from a suspension of solid material.

I claim:

1. A process for the treatment of a fluid fibre suspension in a pressurized screening apparatus, comprising the steps of: injecting said fibre suspension into a first end of a annular screening zone formed between a tubular screen housing and a screen-drum and flowing a finer portion of said suspension through said screen-drum and extracting as accept stock, while retaining coarser material on said screen-drum and discarding as reject stock, wherein said screen-drum is continuously rotated inside said housing and diluting fluid is fed into said screening zone at a plurality of locations along an axial extent of said housing.

2. A process as claimed in claim 1, wherein said diluting fluid is injected through several inlets at an axial distance from each other or continuously along an axial extent of said screening zone.

3. A process as claimed in claim 1, wherein said diluting fluid comprises a fluid selected from the group consisting of a fibre suspension, backwater and water.

4. A process as claimed in claim 1 wherein said accept stock is extracted tangentially to the periphery of said housing.

5. A process as claimed in any one of claims 1 to 4, wherein said accept stock flowing in the interior of said screen-drum is extracted from said screening apparatus by a pumping action provided by a pump wheel disposed in an accept stock outlet end of said housing.

6. A process as claimed in claim 1, wherein said fibre suspension is introduced into said annular screening zone through a fluid inlet nozzle extending axially over a major portion of said screening zone, dilution water is introduced through a dilution liquid inlet nozzle extending axially substantially over said portion of said screening zone, and washing water is introduced through a washing liquid inlet nozzle extending over a further axial length of said screening zone, whereby said fiber suspension is intermittently or continuously diluted in said screening zone, screened through said rotating screen-drum and centrifugally cleaned by the action of a surface profilation of said screen-drum, said accept stock passing through said screen-drum is collected inside said screen-drum and is extracted by a pumping action caused by a pump wheel rotating at an outlet end of said screen housing, and reject and heavy particles present in said fiber suspension are collected on said screen-drum, washed by said washing water and removed from an end opposite of said screen housing opposite to said outlet end of said screen housing.

7. A process for producing paper or board in a papermaking process including the steps of stock feeding, forming of a web on at least one forming fabric while circulating backwater drained through said forming fabric, pressing and drying said web, said process comprising feeding paper stock to an inlet end of a tubular pressurized screening apparatus including a rotating screen-drum inside a stationary housing, introducing diluting fluid through said housing at a plurality of location along the axial extent of a screening zone formed between said screen-drum and said housing to dilute the stock being screened, collecting accept stock inside said screen-drum, and feeding said accept stock to web forming.

8. A process as claimed in claim 7, wherein said diluting fluid comprises backwater circulated as air free flows directly from said forming fabric to fluid inlet means of said screening apparatus for diluting said stock in said screening zone and for washing coarser material accumulating in a reject zone at one end of said screening zone.

9. A process as claimed in claim 7 or 8, wherein said paper stock is fed from stock preparation directly to said screening apparatus and said stock is diluted, screened and cleaned in said screening apparatus, and pumped by said screening apparatus to web forming.

10. A process as claimed in claim 9, wherein said accept stock is pumped by said screening apparatus as a multiple of pulse-free flows into a headbox immediately downstream of said screening apparatus through a distribution piping having a multiple of accept pipes of essentially identical length and flow resistance.

11. An apparatus for the screening of a fibre suspension comprising a tubular housing and a perforated screen-drum inside said housing, a annular screening zone located between said housing and said screen-drum, said screen-drum surrounding a tubular accept channel, said apparatus further comprising inlet means for injection of the fibre suspension, accept outlet means for accepted fibre, and reject outlet means for rejected fibre, said inlet means located at a first end of said screening zone for introducing a fluid inject into said screen zone, wherein said screen-drum is rotatable within said housing and means for introducing a diluting fluid into said annular screening zone at a plurality of locations along an axial extent of said screening zone are provided in said housing.

12. An apparatus as claimed in claim 11, wherein a number of said plurality of locations along the axial extent of said screening zone are merged to form an axially extended inlet means for introducing fluid into said screening zone.

13. An apparatus as claimed in claim 12, wherein said inlet means are arranged in said housing as axially extended nozzles, said nozzles being tangentially directed into said annular screening zone.

14. An apparatus as claimed in claim 11, wherein said means for introducing diluting fluid comprise at least one further inlet means for introducing injected fluids into said screening zone at an axial distance from said first end of said screening zone.

15. An apparatus as claimed in claim 14, wherein said inlet means for introducing injected fluids and said means for introducing diluting fluid are merged to form an inlet means extending axially over a substantial portion of said screening zone for providing a substantially continuous feed of injection over an axial extent of said screening zone.

16. An apparatus as claimed in claim 11, wherein said means for introducing diluting fluid include at least one inlet for feeding washing liquid into said screening zone.

17. An apparatus as claimed in claim 11, wherein said means for introducing diluting fluid include a plurality of liquid inlet means disposed at an axial distance from each other.

18. An apparatus according to claim 11, wherein there is an inlet means connected to an axially extended fluid inlet nozzle for directing injected fluid to a major first portion of said screening zone, at least one dilution liquid inlet means connected to an axially extended liquid inlet nozzle for directing dilution liquid to said first portion of said screening zone, and a washing liquid inlet means for directing washing liquid to a second portion of said screening zone.

19. An apparatus as claimed in claim 18, wherein said fluid inlet nozzle is superimposed over at least a major part of said liquid inlet nozzle.

20. An apparatus as claimed in claim 11, wherein in said screen-drum contains a central body (24; 27), which is of a conical design tapering towards an accept outlet end of said housing.

21. An apparatus as claimed in claim 11, wherein an accept outlet end of said housing includes a wider chamber containing a rotatable wheel.

22. An apparatus as claimed in claim 11, wherein said accept outlet means comprise a multiple of accept outlets extending in one or more layers.

23. An apparatus as claimed in claim 11, wherein stationary turbulence or pressure generating means are provided in said screening zone and in said accept channel.

24. An apparatus according to claim 11, wherein the surface of said screening drum is provided with axially extending screening slots having elevated ridges between said slots for providing a centrifugal cleaning effect at screening.

* * * * *